US005113160A

United States Patent [19]

Campisi

[11] Patent Number: 5,113,160

[45] Date of Patent: May 12, 1992

[54] WIDE BAND CRYOGENIC ULTRA-HIGH VACUUM MICROWAVE ABSORBER

[75] Inventor: Isidoro E. Campisi, Newport News, Va.

[73] Assignee: Southeastern Universities Research Association, Newport News, Va.

[21] Appl. No.: 522,131

[22] Filed: May 11, 1990

[51] Int. Cl.[5] ..... H01P 1/26

[52] U.S. Cl. ..... 333/22 R; 333/81 B

[58] Field of Search ..... 333/22 R, 81 R, 81 B, 333/21 R; 338/216

[56] References Cited

U.S. PATENT DOCUMENTS

| | | | |
|---|---|---|---|
| 2,837,720 | 6/1958 | Saltzman et al. | 333/81 B |
| 2,908,875 | 10/1959 | Blatt et al. | 333/22 R |
| 3,088,082 | 4/1963 | Petrilla et al . | 333/81 R |
| 3,904,993 | 9/1975 | James | 333/22 R |
| 4,760,312 | 7/1988 | Watanabe et al. | 333/22 R X |

FOREIGN PATENT DOCUMENTS

| | | | |
|---|---|---|---|
| 0136702 | 10/1980 | Japan | 333/81 B |
| 0866321 | 4/1961 | United Kingdom | 333/22 R |

*Primary Examiner*—Eugene R. LaRoche
*Assistant Examiner*—Seung Ham
*Attorney, Agent, or Firm*—Staas & Halsey

[57] ABSTRACT

An absorber wave guide assembly for absorbing higher order modes of microwave energy under cryogenic ultra-high vacuum conditions, that absorbs wide-band multi-mode energy. The absorber is of a special triangular shape, made from flat tiles of silicon carbide and aluminum nitride. The leading sharp end of the absorber is located in a corner of the wave guide and tapers to a larger cross-sectional area whose center is located approximately in the center of the wave guide. The absorber is relatively short, being of less height than the maximum width of the wave guide.

20 Claims, 3 Drawing Sheets

WIDE BAND CRYOGENIC ULTRA-HIGH VACUUM MICROWAVE ABSORBER

The United States Government may have certain rights to this invention, under Management and Operating Contract DE-AC05-84ER40150 from the United States Department of Energy.

This invention relates to the shape and materials for microwave energy absorbers that can absorb wide band multi-mode energy under cryogenic ultra-high vacuum conditions.

In the operation of charged-particle, radio frequency (RF) driven accelerators, the accelerated beam is capable of exciting higher order modes (HOM) in the accelerating cavities. This problem is particularly acute in electron linear accelerators employing superconducting RF cavities: if not properly extracted and absorbed, the power of the HOM can feed back into the beam and limit or disrupt the operation of the accelerator.

The present invention is designed to absorb HOM in a wave guide over a wide frequency range (with proper scaling of dimensions, from 100 megahertz to 50 gigahertz or possibly higher) and for multi-moded wave guides. The design, the material and the assembly used for the HOM absorber permits its operation with the described loads in ultra-high vacuum (UHV) and at extremely low temperatures (1 degree Kelvin or less) as well as at temperatures of several hundred degrees Celsius without adverse effects on the vacuum system. The HOM absorber of the present invention enables the absorption of large amounts of power without destabilizing the vacuum system in which the load is located.

Other devices developed for this purpose make use of tuned notch filters to extract the HOM power, but operate over a narrower band width (up to 2–3 times the cavity's fundamental frequency) and do not absorb the RF power directly at low temperature. Instead, the HOM are absorbed at room temperature, making use of cryogenic-vacuum feed-throughs in the cryostat, which complicate the design and the vacuum and cryogenic reliability. Other microwave absorbers, such as ferrites, are either incompatible with operation near a superconductor (because of their remnant magnetic field), and they effectively absorb only over a limited frequency range, or again they are incompatible with cryogenic and/or vacuum operation.

The present invention is based on the use of a dielectric ceramic, preferably a mixture of aluminum nitride (60%) and silicon carbide (40%) manufactured by Ceradyne Inc., Costa Mesa, Calif. This material is sintered at very high temperatures (2300 C), shows zero porosity and has excellent vacuum properties. The silicon carbide in the mixture provides the dielectric losses necessary for the absorption of microwaves. The material has also been tested at low temperature, where its absorption characteristics seem to be maintained if not enhanced.

For an effective absorption of many modes and over a wide frequency range, a careful positioning and shaping of the material which constitutes the load is necessary.

Ideally a large amount of the ceramic would be desirable, with a long, tapered point protruding into the wave guide. In practice, space and cost considerations usually preclude a complete optimization of the load's shape. An effective compromise design has been achieved for a specific use in a continuous electron beam accelerator as follows:

Triangular pieces of 3 in. by 1 in. (long and short orthogonal sides of a right triangle) by 0.5 in. thickness of absorber are located in the wave guide's cross-section at an angle of 40 degrees between the longitudinal axis of the guide of the plane of the ceramic absorber (50 degrees between the normal to the plane of the ceramic absorber and the longitudinal axis of the guide) with the point of the triangle toward one of the corners of the wave guide (see FIG. 2). The point is located as close to the corner of the wave guide as possible without touching in order to first intercept the various modes in a location where the fields are zero or near zero, to improve impedance matching. The main triangular ceramic absorber is held in place at a 50 degree elevation angle to the transverse plane of the wave guide by a ceramic absorber holder of the same composition, which increases the absorption. The design is guided by the principle that the point of the absorber should be in a location where the fields are low for the modes to be absorbed, and that it should taper to a wider cross-sectional shape downstream with largest cross sections at the field maxima of the dominant modes to be absorbed. Upstream and downstream as used herein refer to whether the location is away or toward, respectively, end piece 12.

This choice of shapes allows one the use of a relatively small amount of ceramic which limits the cutting and grinding and thus limits the cost of the absorber assembly. This approach provides 10–20 dB reduction of return losses over a broad spectrum. Although a more perfect shape could possibly provide better absorption, it would be a considerably higher price factor.

A certain amount of mode conversion exists in the load at a few frequencies: an analysis of the reflection curves indicates that mode conversion might contribute at most a reflection of 10% in power for a few modes. In general, mode-converted peaks are 20–30 dB below the unconverted, unabsorbed modes.

The ceramic absorber pieces are held together and to a copper flanged end piece, which attaches to the end of the wave guide, by means of brazing joints: a brazing alloy called Ticusil (4.5% Titanium, 26.7% Copper, 68.8% Silver) manufactured by Wesgo Corporation, Belmont, Calif., is used. Its melting point is 850° C. and a vacuum brazing technique is used for the process. With the present design the stresses induced at the joints of dissimilar materials (ceramic-copper) during the cooling between the brazing temperature all the way to the operating temperature of two degrees Kelvin do not pose a problem of shear at the joint. A safety retainer pin is provided which will prevent the ceramic assembly from falling into the cavity in the unlikely event of a failure of the ceramic to copper braze joint. The flange is designed so that the ceramic is brazed to the copper only over a surface area of 0.5 in. by 0.375 inches. Grooves are provided so that fluids or dust cannot be trapped under the part of the support which is not brazed to the flange.

The HOM microwave absorber described above possesses the following features:

a) It allows multi-mode absorption in the wave guide.
b) It enables HOM to be absorbed over a much wider band than presently available HOM absorbers in superconducting cavities.
c) It can operate in ultra-high vacuum.

d) It can operate over a wide range of temperatures, between one degree Kelvin and close to 1000° K.

The invention is especially usable in high energy continuous beam superconducting radio-frequency (SRF), electron accelerators, such as the one currently under construction at the Continuous Electron Beam Accelerator Facility in Newport News, Va. This type of accelerator uses radio waves to establish the electrical fields that impart energy to moving electrons. These electric fields are confined within hollow metal accelerating devices called cavities. But resistance in the metal of the cavities would normally drain power and, by causing heating, preclude continuous operation. By the use of superconducting radio frequency technology, this problem is solved. Liquid helium chills the accelerating cavities, which are made of niobium, to superconducting temperatures free of resistance. This not only saves power, but the high-energy high current beam does not need to be pulsed to avoid heat build up, so the resulting beam can be continuous. The niobium cavities require rigorous purity, and interior surface cleanliness for proper performance. The cavities are assembled in pairs in the filtered, dust-free air of a special room, and the wave guides and the tuning mechanism are attached. At the end of the wave guide is located the HOM absorber of this invention. The assembly is installed in a cryostat, where liquid helium provides the cryogenic refrigeration to make the niobium superconductive, and also absorbs the heat from the HOM absorber of this invention. Multiple cryostats are joined together in an accelerator tunnel, with wave guides leading upward toward radio-frequency power sources housed at ground level.

The invention will be better understood by the following description of the preferred embodiment, which is set forth in such detail as to enable those skilled in the art to readily understand the function, operation, construction and advantages of the invention when read in conjunction with the accompanying drawings in which.

Figure 1:
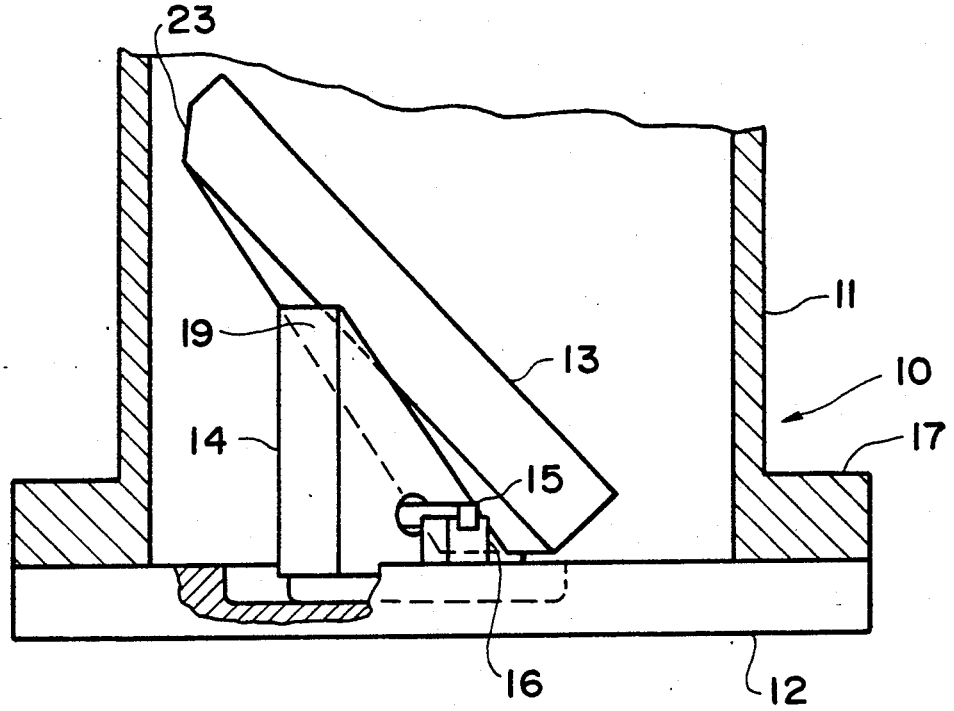
FIG. 1 is a side view of the HOM absorber located in a cross section of a wave guide.
Figure 2:
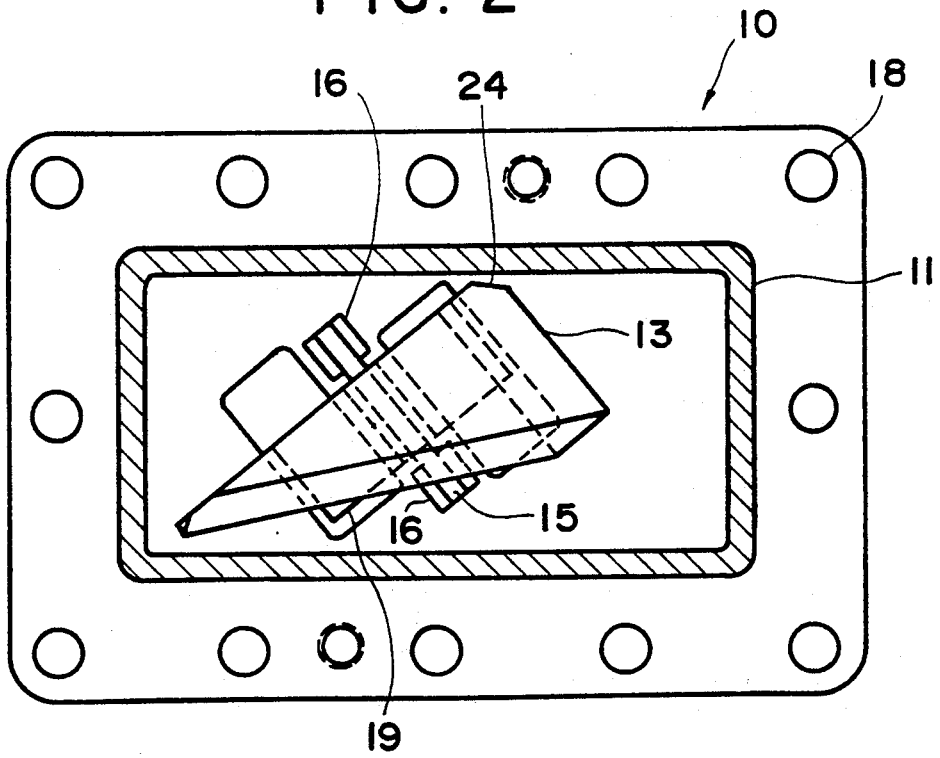
FIG. 2 is plan view of FIG. 1.
Figure 3:
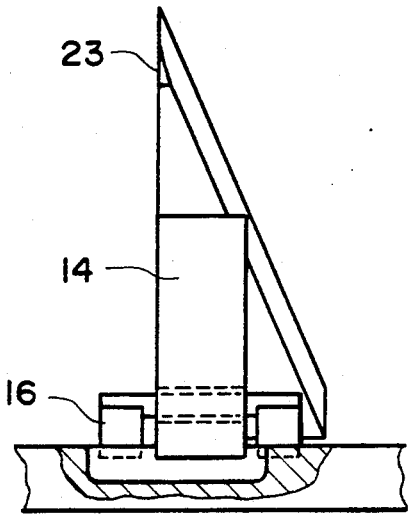
FIG. 3 is a side view of the HOM absorber of FIG. 1, rotated so the full width of the safety retainer peg and the thickness of the absorber holder are viewed directly.

With reference to the drawings, FIGS. 1 and 2 show the HOM absorber or absorber assembly 10, including a stainless steel rectangular wave guide 11, an absorber flanged endpiece 12, a main absorber 13, an absorber holder 14, a safety retainer peg 15, and a safety retainer block 16. The absorber 10 includes both the main absorber 13 and absorber holder 14, both of which are made of absorbing materials. The rectangular wave guide is approximately 3 and 3/16 inches by 4 and ¼ inches, and may vary in size depending on the application. It is made of non-magnetic stainless steel, and at the end has a flange 17.

The wave guide flange 17, as well as the absorber flanged endpiece 12, have a series of holes 18, which are used to bolt the two flanged portions together. The flanges can be held together by either bolts (not shown), brazing, or both. The absorber flanged endpiece 12 is made from a high conductivity material, preferably oxygen-free, high conductivity (OFHC) copper. This conductivity is needed to absorb the heat built up by the main absorber and absorber holder. The flange is in thermal contact with the absorber holder 14, which is in turn in thermal contact with the main absorber 13. Thus, there is a high thermal conductivity pathway to conduct heat from the main absorber and absorber holder through the high conductivity flange. The flange is normally submerged in liquid helium, which serves to withdraw the heat from the flanged endpiece. However, other means of cooling the endpiece may be utilized, such as by being exposed to the temperatures of outer space or having a heat exchanger attached or integrated therewith. This heat exchanger may be fins which are gas cooled, or coolant circulating conduits. Cryogenic temperatures as used herein are temperatures of liquid nitrogen or less.

The main absorber and absorber holder are both preferably made from ½ inch flat tiles, made from approximately 40% silicon carbide and 60% aluminum nitride. Tiles, as used herein, are flat members having two extended surfaces parallel to one another with the edges shaped to the desired contour. They are preferably brazed together at their intersecting faces 19. The material is of critical choice, as it must effectively absorb the high-order modes over a wide band of microwave frequencies under the temperature extremes of cryogenic temperatures as well as the temperatures used to braze the material into the assembly. The most effective material found is silicon carbide, and preferably this would be 100%, as it acts as the absorbing material. However, under present known methods of manufacture, in the sizes needed, the silicon carbide will not stand up to the temperature shifts between brazing and cryogenic temperatures. However, by mixing the silicon carbide with aluminum nitride before sintering, with the ratio of approximately 40% silicon carbide, and approximately 60% silicon nitride, the subsequent sintering creates a non-porous, suitable ceramic which has proved to be excellent. The function of the aluminum nitride is to serve as an excellent thermal conductor, which alleviates thermal shocks in going through the temperature ranges from brazing to cryogenic temperatures. In the broadest sense, a material is desired that has the absorbing characteristics for radio frequencies similar to silicon carbide, or better, provided by a strengthening material, that can improve the thermal conductivity to relieve the stresses resulting from wide temperature shifts. Thus, the material has to have good thermal conductivity, good microwave absorption, zero porosity (which is needed for vacuum purposes), and be relatively easy to braze.

It has been found best to achieve the desired shape for the absorber and absorber holder by fabricating them from ½ inch thick flat tiles, as opposed to being molded to a specific shape. Of course, the thickness can vary from ½ inch, depending on the circumstances. While an optimized shape, in theory, could best be formed to shape, the assembly from flat tiles has proved satisfactory. The problem with an optimized shape is the expense and difficulty of manufacture. The shape must absorb over a wide frequency range, and for several modes. In principal, starting from ceramic powders and sintering them to a shape which is close to the shape desired, could prove to be optimum for shape. However, the cost is much higher because special molds have to be made, probably by machining, and these molds must be able to withstand the high temperatures involved in the sintering operation. All of the ceramic surface would have to be ground when it comes out of the mold, as the irregular surfaces would be in conflict with some of the high vacuum requirements. An irregular surface makes it much easier for dirt to get trapped, and is harder to clean to the cleanliness necessary for a high vacuum use. Investment casting could potentially produce a smooth final surface, but generally investment casting is not done in the high temperatures normally needed. Usually graphite must be used to shape the pieces of the ceramic during sintering. Also, a number of molds would have to be made so that enough will be available during a typical furnace run to occupy the whole furnace with molds. This could additionally add to the cost. This assumes making the moderate quantities normally needed for microwave absorption.

The ½ inch thick tiles are made by first compressing to get the zero porosity required. This is done using moderate compression in the furnace, on the powders which have first been carefully mixed to fill the molds, which are then stacked upon one another to load up the furnace. After sintering, the flat tiles are ground to a smooth finish, and then cut to the desired shape, preferably in straight lines, to assemble into the absorbers such as the main absorber and absorber support.

Figure 5:
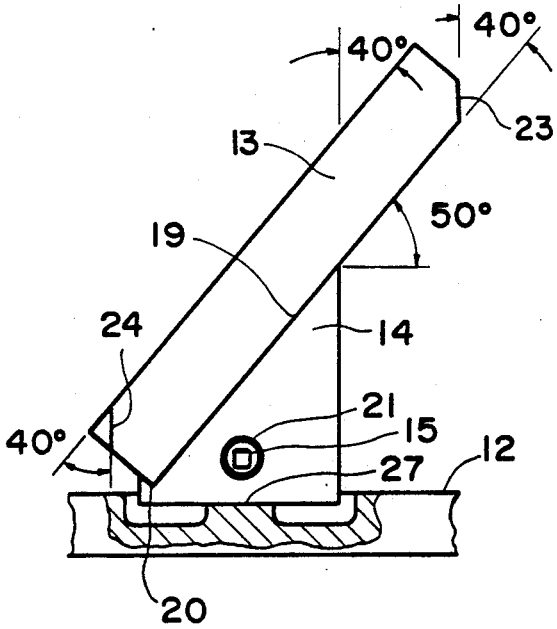
FIG. 5 is a view of FIG. 3, but rotated 90° so the safety retainer peg, absorber holder and main absorber are viewed from the side.
Figure 6:
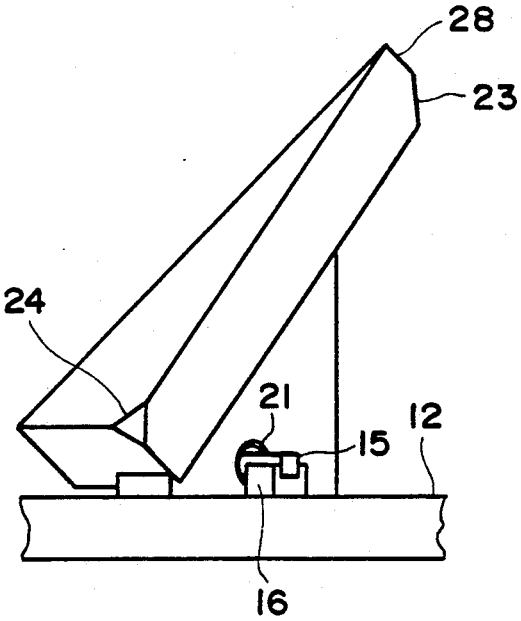
FIG. 6 is a view of the HOM absorber of FIG. 1, rotated 180°.

The shape of the absorber is very important. The absorption is done by both the main absorber 13 and the absorber holder 14, which are brazed together. With reference to FIG. 5, it is seen that the main absorber 13 and absorber holder 14, in side view, are brazed together along their common interface 19.

The preferred size of this absorber holder 14 as viewed in FIG. 5 is 1 and ¼ inch wide, 1 and ½ inch tall, with an inclined surface 50° to the horizontal. At the lower end of the absorber holder is a shoulder 20, upon which the lower end of the main absorber 13 abuts. The shoulder 20 is 0.06 inches deep and 0.019 inches above the bottom.

An orifice 21 is located in the lower part of the absorber holder 14. The orifice is approximately ¼ inch in diameter, which will permit a safety retainer peg 15 to be loosely fitted therein. The safety retainer peg is approximately 0.12 inches square. As seen in FIG. 5, at each end of the center bridge portion 26 are brazer two safety retainer peg blocks 16. The safety retainer blocks have a recess into which the safety retainer peg 22 is brazed. Both the safety retainer peg block and the safety retainer peg are made of OFHC copper. The safety retainer peg passes through the orifice 21 in the absorber holder, and is smaller than the orifice.

The main absorber 13 is also located at an approximate 50° angle to the horizontal, and is mounted on the absorber holder 14 by brazing at the interface 19.

Figure 4:
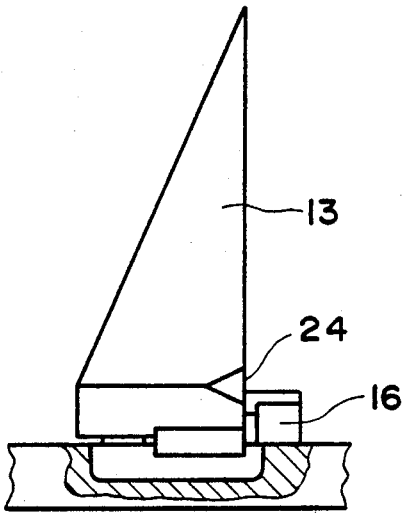
FIG. 4 is similar to the view of FIG. 3, but rotated 180°.

With reference to FIGS. 4 and 5, it is seen that the main absorber 13 is shaped in the form of a right triangle, with the longer of the orthogonal sides being 3 inches, and the shorter of the orthogonal sides being 1 inch. With the sides including the hypotenuse being squarely cut across the thickness of the main absorber. The remote end of the main absorber, as measured from the flange 12, has a cut-off corner 23 at a 40° angle, and the near end, as measured from the flange 12 has a cut-off corner 24 cut at a 40° angle. The two cut-off corners are to better accommodate the triangular-shaped main absorber within the rectangular wave guide. The main absorber is shaped to just clear the walls of the wave guide at the leading end 28 and the trailing end 24, with sufficient clearance to permit easy assembly without contacting the walls. The advantages of the cut-off corner 23, in permitting the main absorber 13 to be closer to the corner of the wave guide, is best seen in FIGS. 1 and 2. Likewise, the advantage of the cut-off corner 24, in permitting the main absorber to be located closer to the wall of the wave guide, is best seen in FIG. 2.

Figure 10:
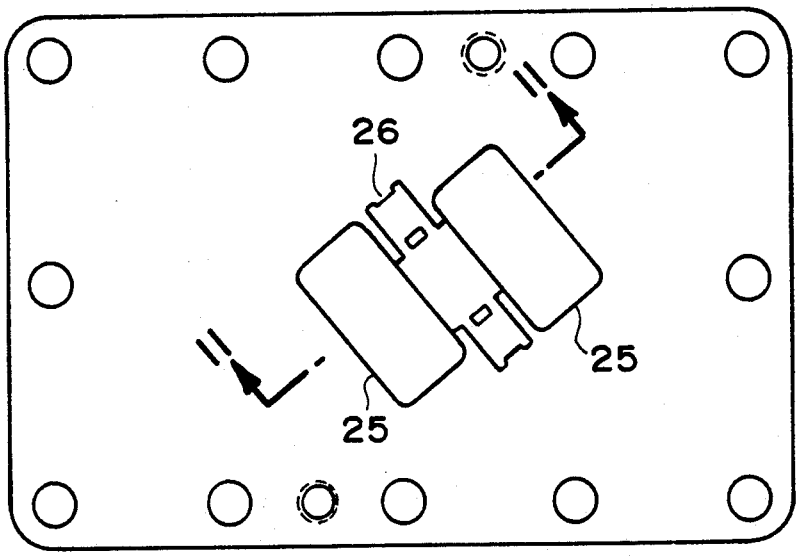
FIG. 10 is a plan view of the absorber flanged endpiece, showing the cavity cut therein.

As shown in FIG. 10, the flanged endpiece 12 has cavities milled therein. The two outer cavities 25 are below the absorber support block, and the center bridge portion 26 is used to support the absorber holder in a small area so as to minimize the amount of differential movement during swings of temperature. The absorber holder is brazed to the center bridge portion at their interface 27, as seen in FIG. 5. The absorber holder has a 0.062 inches deep notch that is 0.038 inches wide to accommodate the center bridge portion.

Each end of the safety retainer peg 15 is brazed to safety retainer peg blocks 16. The safety peg retainer blocks have a recess into which the safety retainer peg 15 is brazed. Both the safety retainer peg block and the safety retainer block are made of OFHC copper. The safety retainer peg passes through the orifice 21 in the absorber holder, and is smaller than the orifice so there can be relative movement between the absorber holder and the safety retainer peg during thermal changes. If somehow the main absorber and absorber holder get loose from their mounting on the flange, they are prevented from falling into the wave guide by the safety retainer peg.

The brazing of the main absorber 13 to the absorber holder 14, the absorber holder 14 to the flanged endpiece, the safety retainer peg to the safety retainer peg block, and the safety retainer peg block to the flange is carried out preferably by using the brazing alloy Ticusil, mentioned earlier.

Generally speaking, the main absorber is in the form of a triangularly shaped flat tile, having a knife edge 28 located between the long orthogonal side and the hypotenuse, and designed to fit into a corner of the rectangular wave guide. Since a knife edge is easy to chip, it is slightly flattened or rounded to a maximum width of 1/64 inch. The knife edge is located remotely from the flanged endpiece upon which the main absorber and absorber holder are mounted.

The main absorber and absorber holder triangles widen out as they approach the flanged endpiece. This widening out of the main absorber and absorber holder in effect increases the cross sectional area of the combined main absorber and the absorber holder, and thus the absorption capability.

Figure 7:
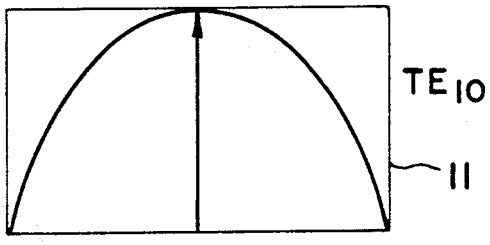
FIG. 7 shows the distribution of the $TE_{10}$ mode, looking down the rectangular wave guide.
Figure 8:
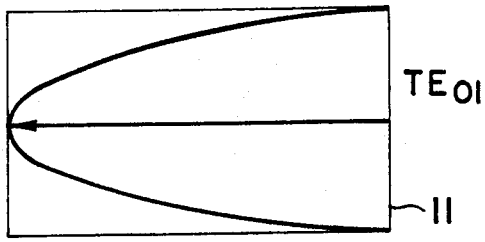
FIG. 8 shows the distribution of the $TE_{01}$ mode, looking down the rectangular wave guide.
Figure 9:
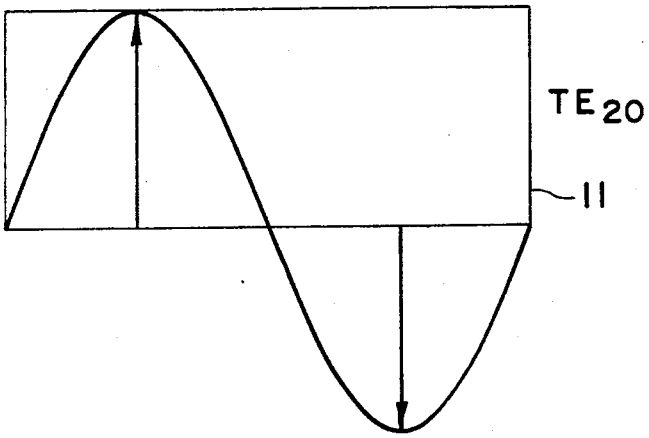
FIG. 9 shows the distribution of the $TE_{20}$ mode, looking down the rectangular wave guide.
Figure 11:
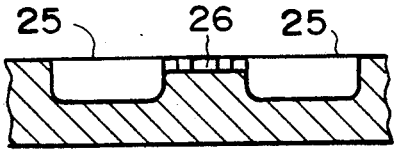
FIG. 11 is a broken-away cross section along cross section 11—11 of FIG. 10.

The microwaves we are mostly concerned with are the $TE_{10}$ mode as shown in FIG. 7, and the $TE_{01}$ mode shown in FIG. 8. As is seen by these two figures, the maximum intensity of the first is along the center line of the wave guide 11, as measured across the short part of the rectangle, and the maximum for the $TE_{01}$ is along the center line, as measured across the long side of the rectangle. Another mode of somewhat less critical importance is the $TE_{20}$ mode shown in FIG. 9, where the maximum intensity is located one-quarter of the way from a short side of the rectangular wave guide, and parallel thereto. Therefore, it is desired that the center of maximum cross section of the combined main absorber and absorber holder referred to herein as the absorber or absorber assembly be located along the center line of the wave guide. This does not have to be exact, and all other modes will also interact to some extent with the main absorber and the absorber holder, if they are properly located in these positions. The cross-section of the absorber is the plane that is transverse to the longitudinal axis or centerline of the wave guide.

The position of the maximum cross section of the absorbing material can be optimized to dampen or attenuate the absorption of a specific mode. The reason the $TE_{10}$ and $TE_{01}$ modes are so critical, with the $TE_{20}$ mode also being important, is that these modes only appear at above certain frequencies, called the cut-off frequencies. The $TE_{10}$ mode is the one that appears at the lowest frequency, and therefore it is desired to be able to absorb that mode, starting from the lowest frequency, and so more effort must be placed in absorbing that mode. The other two modes, depending on the size of the wave guide, appear at frequencies which are approximately twice the frequency at which the $TE_{10}$ mode appears. Because of the field structure, usually if the system is designed to be capable of absorbing the $TE_{10}$ mode, the $TE_{20}$ mode is relatively easy to absorb. The $TE_{01}$ mode is present in a field orthogonal to the $TE_{10}$, so some care has to be placed in making sure that this mode is likewise absorbed.

It is to be noted that the absorber of this invention is relatively stubby or short, as opposed to some absorbers used in the past. Preferably, the absorber is shorter than the maximum width of the wave guide in which it is mounted. Some of the general principles of the invention are to start the absorption in the wave guide at a small cross sectional area, such as the knife edge, in a corner remote from the flanged endpiece to which the assembly is mounted. Then, as the absorber approaches the endpiece, it increases in cross sectional area. This arrangement is utilized in part because of the system being designed to absorb multi-modes. The main absorber and absorber support approach to almost touching the walls of the wave guide near the end, with the cross section tending to be at a maximum at the center of the wave guide near the end. While the invention as shown in the figures may not have the maximum cross-section of the absorbing material exactly at the center, it is reasonably close and works well.

The triangular main absorber and absorber holder are easier to make than other shapes, and give enough flexibility to locate the assembly in the wave guide cross section. The absorber can be varied with different sizes of wave guides. The present invention provides an absorber of a size that gives enough flexibility to locate the absorbing materials to absorb different modes in different frequencies. The absorbing material used in the invention is relatively small, and if it was large, as has been used in the past, it would restrict the ability to locate the assembly at an optimum location. On the other hand, if the assembly is too small, then there is not enough material for effective absorption. For the specific requirements of the intended application of the invention, the design set forth herein is close to being an optimum arrangement.

Even though other sizes were tried, such as 3 and ½ inch and 4 inch in length, as opposed to the 3 inches preferred, and different thicknesses, including 1 inch thickness, were tried, and the short orthogonal leg of the triangle was increased to 1 ½inches, and also 60% concentration of silicon carbide were all tried. It was found that the optimum absorber for the specific size wave guide and frequencies and modes encountered was the absorber set forth herein.

It would appear that filling the wave guide with absorbing material would be more efficient, but this is not true. It would require that the absorber be longer by almost a factor of two, and thus lose the advantage of the absorber being very compact, as set forth in the disclosure. There is a criterion of the ratio between the dielectric constant and magnetic permeability. Since the magnetic permeability in the present instance is one, everything is dominated by the dielectric constant. If a slab of the absorbing material was put across the wave guide, then the difference in dielectric constant would cause a reflection of the microwave, which would reduce the absorption capacity of the absorber and absorber support. So the advantage of the taper prevents this reflection, or at least reduces it to levels such that it is not a problem. This is accomplished by the relatively sharp or narrow cross sectional absorbing area that is first contacted by the microwaves. The angle of attack of the taper prevents the wave from being reflected in spite of the fact that the material that absorbs the wave has a dielectric constant different than the dielectric constant of the vacuum, which is one. That is the reason that the absorber must be at an angle. If the whole area was filled, the absorber would have to extend much further into the wave guide.

The angle of the main absorber is critical, and it is found that 50°, as shown in the drawings in FIG. 5, for the lead-in angle is the optimum. This can be varied from approximately 45°. to 55°. This angle is measured between the plane of the absorber and the horizontal which is complementary to the angle between the longitudinal axis of the wave guide on the plane of the absorber, which is 40°, as shown in FIG. 5. Thus, this complementary angle may vary from 35° to 55°.

While specific dimensions have been shown relative to the specific embodiment, it is understood that these dimensions and the choice of materials can be varied in different applications, so long as they are consistent in dimensions and materials with the invention and its concepts set forth herein. Numerous other alterations may become apparent to those skilled in the art. It is to be understood that the present disclosure relates to a preferred embodiment of the invention, which is for the purpose of illustration only, and not to be construed as a limitation to the scope of the invention.

What is claimed is:

1. A mode absorber for absorbing unwanted higher order modes of microwave energy from rectangular wave guides, comprising:

an absorber having a leading end and a trailing end capable of absorbing unwanted higher order modes of microwave energy over a wide frequency range having a cross section area as measured transverse to the centerline of the wave guide in which it is to be mounted that varies from a very small area at the said leading end of said absorber to a maximum cross section area towards said trailing end of said absorber, and said absorber being shaped so said leading end is positioned in one corner of the rectangular wave guide and tapering downstream to said maximum cross section area with the center of said maximum cross section being located in the approximate vicinity of the longitudinal center line of the wave guide in which the absorber will be mounted.

2. The mode absorber of claim 1, wherein the height of said absorber is less than the maximum width of the wave guide in which it is to be located.

3. The mode absorber of claim 1, wherein said absorber is triangular in shape.

4. The mode absorber of claim 1, wherein said absorber is a combination of first and second flat generally triangular tiles, and said first tile being a main absorber and said second tile being an absorber which supports said first absorber and both tiles being joined together in a manner that permits good heat conduction from said first tile to said second tile.

5. The mode absorber of claim 4, wherein said first tile absorber has a knife-edge leading end.

6. The mode absorber of claim 4, wherein said second tile is mounted in a thermal conducting manner on a high conductivity endpiece adapted to be attached to wave guide.

7. The mode absorber of claim 6, wherein said endpiece has two cavities connected by a bridge with said second tile mounted on said bridge.

8. The mode absorber of claim 6, wherein said second tile has an orifice through the tile;

an elongated safety member positioned in said orifice with a substantial surrounding clearance and with ends protruding beyond said second tile; and mounting means for fastening said protruding ends to said endpiece.

9. The mode absorber of claim 1, wherein said absorber is composed of silicon carbide and aluminum nitride.

10. The mode absorber of claim 1, wherein said absorber is composed of approximately 40% silicon carbide and approximately 60% aluminum nitride.

11. The mode absorber of claim 7, composed of approximately 40% silicon carbide and approximately 60% aluminum nitride.

12. The mode absorber of claim 4, wherein said first tile has two parallel flat faces and is mounted so that it will be positioned in the wave guide with the flat faces at a 35° to 45° angle to the centerline of the longitudinal axis of the wave guide.

13. The mode absorber of claim 4, wherein said first tile has two parallel faces and is mounted so that it will be positioned in the wave guide with the flat faces at approximately a 40° angle to the centerline of the longitudinal axis of the wave guide.

14. The mode absorber of claim 6, wherein said endpiece includes a means for removing heat therefrom.

15. A process for absorbing higher order modes of microwave energy over a wide frequency range from a wave guide held at cryogenic temperatures, comprising the steps of:

providing a microwave energy carrying rectangular wave guide having a flanged opening at one end;

providing an absorber having a sharp leading end extending into said flanged opening and divergently tapering downstream, said absorber being capable of absorbing unwanted higher order modes of microwave energy over a wide frequency range;

positioning said absorber so that said leading end is in close proximity to one corner of said wave guide and the center of the maximum cross section of said absorber as measured transverse to the longitudinal axis of said wave guide is located approximately at the longitudinal axis of the wave guide;

providing a flanged endpiece for attaching to said wave guide flanged opening;

providing a thermally conducting attachment between said flanged endpiece and said absorber, and providing a means for extracting heat from said flanged end piece.

16. A mode absorbing wave guide assembly for absorbing unwanted higher order modes of microwave energy, comprising:

a rectangular wave guide having an opening with a flange at the end;

an absorber having a leading end and a trailing end capable of absorbing unwanted higher order modes of microwave energy over a wide frequency range having a cross section area as measured transverse to the wave guide in which it is to be mounted that varies from a very small area at the said leading end of said absorber to a maximum cross section area towards said trailing end of said absorber, said absorber being shaped so said leading end is positioned in one corner of the rectangular wave guide and tapering downstream to said maximum cross section area with the center of said maximum cross section being located in the approximate vicinity of the longitudinal center line of the wave guide in which the absorber will be mounted, and a flanged endpiece of high conductivity material supporting said absorber with a thermally conducting connection.

17. The mode absorber wave guide assembly of claim 16, wherein the height of said absorber is less than the maximum width of said wave guide.

18. The mode absorber wave guide assembly of claim 17, wherein said absorber is a combination of first and second flat generally triangular tiles, said first tile being a main absorber and said second tile being an absorber which supports said first absorber and both tiles being joined together in a manner that permits good heat conduction from said first tile to said second tile.

19. The mode absorber wave guide assembly of claim 18, wherein said absorber is composed of approximately 40% silicon carbide and approximately 60% aluminum nitride and the entire assembly is maintained at cryogenic temperatures.

20. The mode absorber wave guide assembly of claim 19, wherein said first tile has two parallel flat faces and is mounted so that it will be positioned in the wave guide with the flat faces at a 35° to 45° angle to the centerline of the longitudinal axis of the wave guide.

* * * * *